US008387273B2

(12) United States Patent
Driussi

(10) Patent No.: US 8,387,273 B2
(45) Date of Patent: Mar. 5, 2013

(54) HEAT-PUMP CLOTHES DRYING MACHINE

(75) Inventor: Diego Driussi, Porcia (IT)

(73) Assignee: I.M.A.T. S.p.A., Fontanafredda, Pordenone (IT)

( * ) Notice: Subject to any disclaimer, the term of this patent is extended or adjusted under 35 U.S.C. 154(b) by 364 days.

(21) Appl. No.: 12/809,333

(22) PCT Filed: Jun. 3, 2008

(86) PCT No.: PCT/EP2008/056832

§ 371 (c)(1),
(2), (4) Date: Jun. 18, 2010

(87) PCT Pub. No.: WO2009/106150

PCT Pub. Date: Sep. 3, 2009

(65) Prior Publication Data

US 2010/0307018 A1 Dec. 9, 2010

(30) Foreign Application Priority Data

Feb. 27, 2008 (IT) ..... PN2008A0015

(51) Int. Cl.
*F26B 25/04* (2006.01)

(52) U.S. Cl. ..... 34/524; 34/595; 34/79; 8/137; 32/175; 165/11.1; 700/277; 236/1 EA

(58) Field of Classification Search ..... 34/381, 34/524, 595, 74, 77, 78, 79; 8/137; 62/125, 62/127; 165/11.1; 700/277; 236/1 EA
See application file for complete search history.

(56) References Cited

U.S. PATENT DOCUMENTS

| | | | | |
|---|---|---|---|---|
| 4,234,927 | A * | 11/1980 | First | 700/277 |
| 4,535,602 | A * | 8/1985 | Alsenz et al. | 62/175 |
| 7,665,225 | B2 * | 2/2010 | Goldberg et al. | 34/73 |
| 7,866,061 | B2 * | 1/2011 | Tatsumi et al. | 34/595 |
| 2006/0179676 | A1 * | 8/2006 | Goldberg et al. | 34/77 |
| 2008/0289209 | A1 * | 11/2008 | Han et al. | 34/74 |
| 2010/0307018 | A1 * | 12/2010 | Driussi | 34/79 |
| 2011/0289696 | A1 * | 12/2011 | Colin et al. | 8/137 |
| 2012/0079736 | A1 * | 4/2012 | Lee et al. | 34/476 |
| 2012/0210597 | A1 * | 8/2012 | Bison et al. | 34/524 |

FOREIGN PATENT DOCUMENTS

| | | | |
|---|---|---|---|
| DE | 4306215 | A1 * | 9/1994 |
| DE | 4306217 | A1 * | 9/1994 |
| DE | 102005062940 | | 7/2007 |
| DE | 102006061212 | | 3/2008 |
| EP | 999302 | A1 * | 5/2000 |
| EP | 1983095 | A2 * | 10/2008 |
| JP | 2009195363 | A * | 9/2009 |
| JP | 2009219789 | A * | 10/2009 |
| WO | 2005/080896 | | 9/2005 |
| WO | WO 2009106150 | A1 * | 9/2009 |
| WO | WO 2010003936 | A1 * | 1/2010 |

* cited by examiner

*Primary Examiner* — Stephen M. Gravini
(74) *Attorney, Agent, or Firm* — Shoemaker and Mattare

(57) ABSTRACT

The present invention relates to a heat-pump clothes drying machine, in particular a heat-pump arrangement for removing moisture from and heating up the drying air; said heat-pump arrangement comprises a plurality of separate closed-loop circuits, each one of said separate closed-loop circuits comprising at least one compressor (20, 30; 220, 230; 320, 330), at least one evaporator (22, 32; 222, 232; 322, 332), at least one expansion valve (24, 34; 224, 234; 334, 324), and at least one condenser (26, 36; 226, 236; 336, 326).

16 Claims, 3 Drawing Sheets

| COMPRESSOR 20 | COMPRESSOR 30 | CONDITION |
|---|---|---|
| 0 | 0 | OFF |
| 1 | 0 | FIRST CLOSED-LOOP CIRCUIT ON |
| 0 | 1 | SECOND CLOSED-LOOP CIRCUIT ON |
| 1 | 1 | FIRST AND SECOND CLOSED-LOOP CIRCUIT ON |

HEAT-PUMP CLOTHES DRYING MACHINE

The present invention relates to a heat-pump clothes drying machine, in particular a heat-pump arrangement for removing moisture from and heating up the drying air.

A vapour-compression heat pump is widely known to be a thermal machine that works by transferring heat from a lower temperature to a higher temperature. In general, such a heat pump consists of a closed-loop circuit comprising a compressor, a condenser, a throttle member, and an evaporator. Flowing inside the closed-loop circuit there is a refrigerant medium that goes through a complete thermodynamic cycle. The compressor causes the pressure and the temperature of the refrigerant medium to increase to thereby force it into the condenser, where part of the heat taken up from the evaporator and resulting from the mechanical work of the same compressor is released to the outside of the closed-loop circuit. The passage of the refrigerant medium into and through the evaporator takes place by virtue of the pressure difference existing between the inlet and the outlet of the throttle valve, where a first subtraction of heat takes place, actually, however to no practical avail as far as the refrigerating effect is concerned. When it reaches in this way into the evaporator, the refrigerant medium takes up an amount of heat from the outside of the closed-loop circuit and flows then back to the compressor to thereby start a new cycle.

Also largely known in the art is the fact that a clothes drying machine, such as a tumble dryer or a so-called washer-dryer, using a heat-pump arrangement installed therein, includes a circuit in which a stream of air is continuously circulated to affect, further to the clothes to be dried being tumbled in a rotating drum, the evaporator (cold side) and the condenser (hot side) as required to carry out a drying process. The drying air is circulated in said circuit by means of a fan, which is usually located between the condenser and the clothes-holding drum.

The flow of hot moisture-laden air exiting the clothes-holding drum passes first through the evaporator and then through the condenser for it to be dehumidified and heated up, respectively. Thereafter, the flow of air returns into the rotating drum holding the clothes being dried.

During the operation of a heat-pump clothes drying machine, an amount of the electric energy taken in from the power supply line by the compressor is therefore converted into heat, i.e. the so-called compression heat, which is available for use to practical drying purposes. However, some operating cycles of clothes drying machines require more power or less power than other cycles to be performed. So, for instance, an economy drying cycle or a drying cycle being performed overnight certainly need less power than a fast-drying or intensive cycle. As a result, it is reasonable to think of properly controlling the power input to, i.e. the electric power taken in and used by the compression system of the refrigerant medium on the basis of, i.e. in accordance with the actual needs or requirements, so as to optimize the overall energy usage of the heat-pump clothes drying machine.

Various solutions have in the meanwhile been proposed in this connection. As heat-pump clothes drying machines and refrigeration machines in general kept evolving in the course of these last few years, however, a trend has become dominating towards the use of variable-speed compressors. In a heat-pump clothes drying machine provided with a compressor of such kind, in fact, a quantity being output by the compressor, e.g. a flow rate or a delivery pressure, can be varied according to the actual requirements of each single operating cycle performed by the machine, in view of supplying the correct power. The adjustable-speed compressor operates with synthetic refrigerant media, such as R134a, R407, R410, etc., and contemplates the use of an electronic driving device as consisting generally of an electronic inverter and a filtering circuit.

An example in this connection is disclosed in the German patent application no. 102005041145, which describes a heat-pump clothes drying machine, in which a controller is programmed to control the output quantity of the compressor on the basis of some input parameters, such as the moisture content or the temperature of the clothes to be dried, or the temperature of the refrigerant medium circulating in the heat-pump arrangement.

A drawback connected with the use of a variable-speed compressor in a clothes drying machine basically derives from the need for such electronic driving device to be associated thereto.

It is therefore an object of the present invention to do away with such and other drawbacks of prior-art solutions by providing a heat-pump clothes drying machine that does not necessarily require the use of any particular variable-speed driving system, thereby ensuring greater overall reliability and application simplicity.

A further, equally important purpose of the present invention is to provide a heat-pump clothes drying machine that is capable of being manufactured with the use of readily available equipment, tools and techniques.

Some advantageous developments and improvements are set forth in the appended claims, wherein it may be appropriate to put the emphasis on the fact that the possibility is created for the overall thermodynamic yield, or output, of the heat pump to be properly adjusted in view of optimizing it in accordance with, i.e. based on the various operating cycles due to be performed by the clothes drying machine.

According to the present invention, the above-indicated aims, features and advantages, along with further ones that will become apparent from the following disclosure, are reached in a heat-pump clothes drying machine incorporating the characteristics as defined and recited in the appended claims.

Features and advantages of the present invention will anyway be more readily understood from the description of an exemplary embodiment thereof that is given below by way of non-limiting example with reference to the accompanying drawings, in which.

Figures 1, 2:
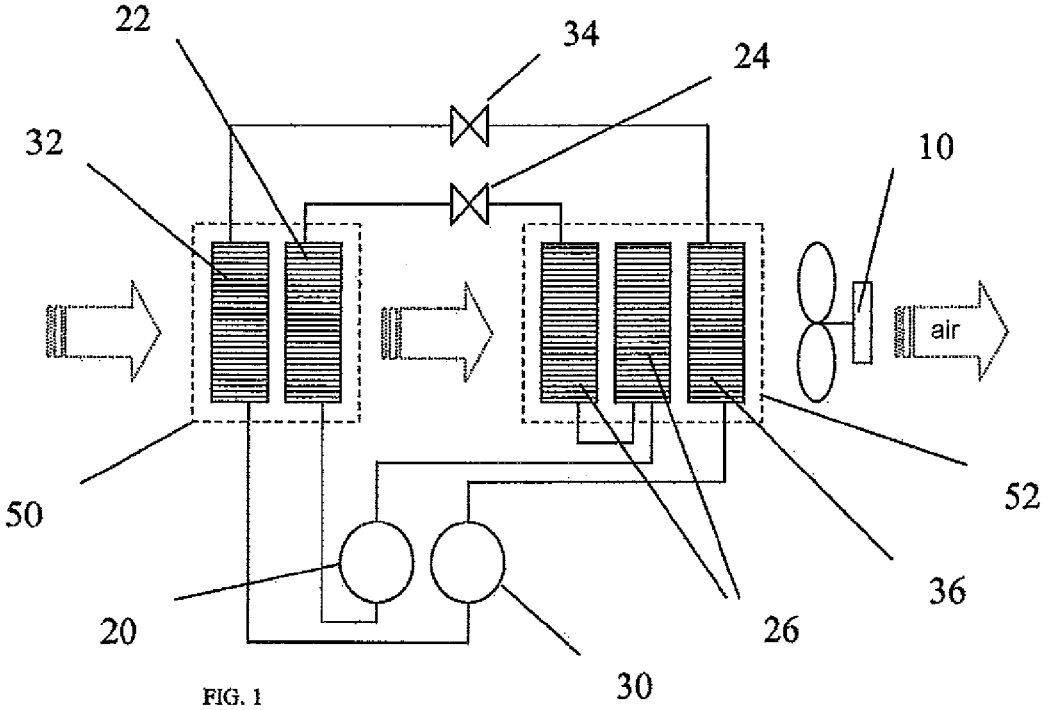
FIG. 1 is a schematic view of a heat-pump arrangement according to an embodiment of the present invention.
FIG. 2 is a view illustrating an exemplary control scheme of the heat-pump arrangement.

Illustrated schematically in FIG. 1 is a detail of a clothes drying machine representing a heat-pump arrangement according to an embodiment of the present invention. The heat-pump arrangement is a multi-compressor one; in the case being considered, for reasons of greater illustrative simplicity such arrangement is assumed to comprise a number of two small-size compressors of the fixed-speed type.

The heat-pump arrangement is subdivided into a first closed-loop circuit and a second closed-loop circuit, said two circuits being completely separate from each other. The first closed-loop circuit forms a first heat pump and is comprised of a first fixed-speed compressor 20, a first evaporator 22, a first expansion valve 24, and a first condenser 26. A second closed-loop circuit forms a second heat pump and is comprised of a second fixed-speed compressor 30, a second evaporator 32, a second expansion valve 34, and a second condenser 36.

All items and parts of a similar kind used or included in the first closed-loop circuit and the second closed-loop circuit, respectively, may have different design specifications and ratings; so, for instance, the first fixed-speed compressor 20 may provide a greater refrigerating capacity or power than the second fixed-speed compressor 30 and/or the first condenser 26 may be provided with a larger heat-exchange surface area than the second condenser 36, and so on. Therefore, the thermodynamic cycles performed by the refrigerant medium in the first closed-loop circuit and the second closed-loop circuit may be different. As a result, one of these closed-loop circuits may for instance be capable of working at a higher evaporation/condensation temperature than the other closed-loop circuit. Based on these considerations it can readily be appreciated that the possibility is therefore given for the first and the second closed-loop circuit to be thermodynamically optimized independently of each other, actually, in view of most suitably complying with the requirements of specific operating cycles, i.e. drying programmes provided for the machine to be able to carry out.

With reference to a flow of drying air brought about by the operation of a fan 10 of the clothes drying machine, the second evaporator 32 is situated at an upstream location relative to the first evaporator 22 and the first condenser 26 is in turn situated at an upstream location relative to the second condenser 36. That is, the evaporators 22, 32 are disposed in series in the air flow path, as are the condensers 26, 36. On the other hand, the first evaporator 22 and the second evaporator 32 may be combined together to form an evaporator 50 of the multi-compressor heat-pump arrangement; in turn, the first condenser 26 and the second evaporator 36 may be combined together to form a condenser 52 of the multi-compressor heat-pump arrangement.

The flow of drying air is caused to first pass through the evaporator 50 and then through the condenser 52 for it to be dehumidified and heated up, respectively; then, it is conveyed back into a drum (not shown) provided to hold and tumble the clothes placed therein for drying.

The flow of drying air that passes first through the evaporator 50 and then through the condenser 52 is dehumidified and heated up, respectively, in accordance with the circuit configuration provided for the specific operating cycle being carried out by the clothes drying machine. For example, during low-noise or economy drying cycles, only a single one of said two fixed-speed compressors 20, may be allowed to operate and, as a result, just a single closed-loop circuit may be used, actually. Conversely, during a fast or intensive drying cycle, or in the first stage of a regular drying cycle (in which a greater power is required), both compressors 20, 30 may be operating, so that both closed-loop circuits would be used. In other words, the flow of drying air can be dehumidified in an adjustable manner by acting on the two compressors 20, 30 accordingly, i.e. letting them operate either separately or in combination according to a binary logic, as this is represented in FIG. 2. This operation scheme of the compressors 20, 30 may be set either manually by a user or automatically through an automatic device installed in the clothes drying machine.

As a result, form a functional point of view, the pair formed of said fixed-speed compressors 20, 30 ensures a refrigerating capacity, i.e. power that is each time exactly tailored to the actual drying cycle, which the clothes drying machine is set or required to carry out. A plurality of such fixed-speed compressors may of course be used, so that it can be stated that, in general, for an arrangement including n fixed-speed compressors, the possible circuit configurations of the heat-pump arrangement according to the present invention will amount to $2^n$-1. This practically translates into the possibility for $2^n$-1 different thermodynamic yields to be obtained.

It should furthermore be particularly stressed that small-size fixed-speed compressors of the above-cited kind are very quiet in operation. These fixed-speed compressors are also very low in space requirements, so that they are suitable for installation in generally small-sized clothes drying machines designed for use in households.

Advantageously, a multi-compressor heat-pump clothes drying machine of the above-mentioned kind can also be readily appreciated to be able to operate, i.e. go through a drying cycle, even in the case that one of the two fixed-speed compressors 20, 30 used in the related heat-pump arrangement should fail, i.e. run into an out-of-order condition, although it would of course take a correspondingly longer time to complete the drying cycle.

Figure 3:
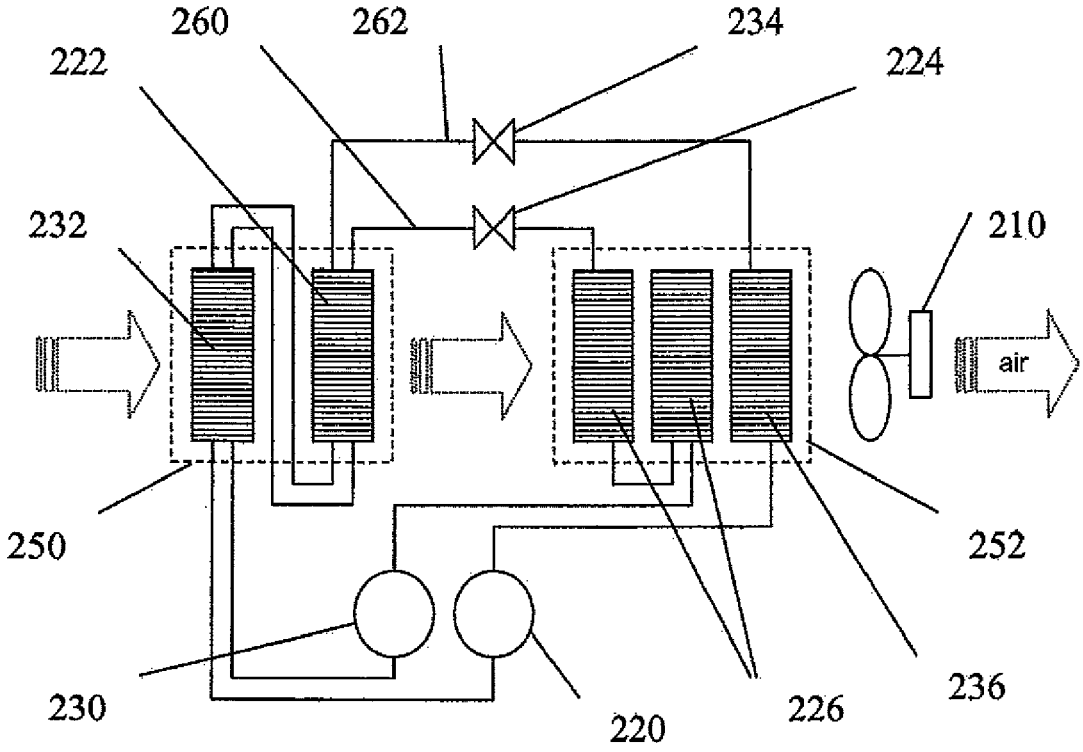
FIG. 3 is a schematic view of a first variant in the embodiment of the present invention.

FIG. 3 is a schematic view illustrating a first variant in the embodiment of the present invention, wherein—for reasons of greater illustrative simplicity—the multi-compressor heat-pump arrangement is shown again to be subdivided into a first closed-loop circuit and a second closed-loop circuit, each one of these circuits being operated by a first small-size fixed-speed compressor 220 and a second small-size fixed-speed compressor 230, respectively. In addition, said first and second closed-loop circuits comprise a first expansion valve 224 and a second expansion valve 234, a first condenser 226 and a second condenser 236, and a first evaporator 222 and a second evaporator 232, respectively. Even in this case there may of course be used and provided any number of, i.e. n closed-loop circuits to form the heat-pump arrangement as desired.

A first duct 260 extending from the expansion valve 224 is connected with the first evaporator 222; a second duct 262 extending from the expansion valve 234 is connected with the first evaporator 222, as well. The first evaporator 222 is formed internally of two separate coils connecting to the first duct 260 and second duct 262, respectively. These separate coils are peculiar in that they share a first outer common heat-exchange surface. At the outlet of the evaporator 222, these two separate coils are connected to two respective distinct ducts that connect in turn to the evaporator 232. The evaporator 232 has a similar structure as the evaporator 222; as a result, such two distinct ducts practically connect to two respective separate coils developing and extending inside the evaporator 232 itself. Again, the two separate coils in the evaporator 232 are provided to share a second outer common heat-exchange surface. At the outlet of the evaporator 232, these two separate coils connect to two further ducts, respectively, which lead to the compressors 220, 230 to thereby close both the first and second closed-loop circuits of the heat-pump arrangement. Each one of the two closed-loop circuits forms a distinct heat pump, due to them being kept strictly separate from each other from a refrigerant-medium circulation point of view.

The remaining part of the structure is identical to the one considered in connection with the afore-described embodiment and, therefore, with reference to a flow of drying air being circulated by the operation of a fan 210, the evaporator 232 is situated at an upstream location relative to the evaporator 222 and the condenser 226 is in turn situated at an upstream location relative to the condenser 236, so that the evaporators 222, 232 and the condensers 226, 236 may again be combined together to form an evaporator 250 and a condenser 252 of the multi-compressor heat-pump arrangement.

From a functional point of view, this modified embodiment of the present invention does not differ from the first afore-described embodiment thereof, so that all considerations set forth afore in connection thereto still apply, without any need arising for them to be expounded any further.

On the other hand, it will most readily appreciated that a kind of construction, in which the condenser element of the arrangement develops internally with two or more separate coils sharing a common outer heat-exchange surface—all other structural parts of the clothes drying machine remaining unaltered—has to be understood as falling within the concept of this modified embodiment of the present invention. For the same reason, even a kind of construction, in which both the evaporator and the condenser elements of the arrangement develop internally with two or more separate coils sharing a common outer heat-exchange surface—all other structural parts of the clothes drying machine remaining unaltered—has to be understood as further falling within the concept of this modified embodiment of the present invention.

Figure 4:
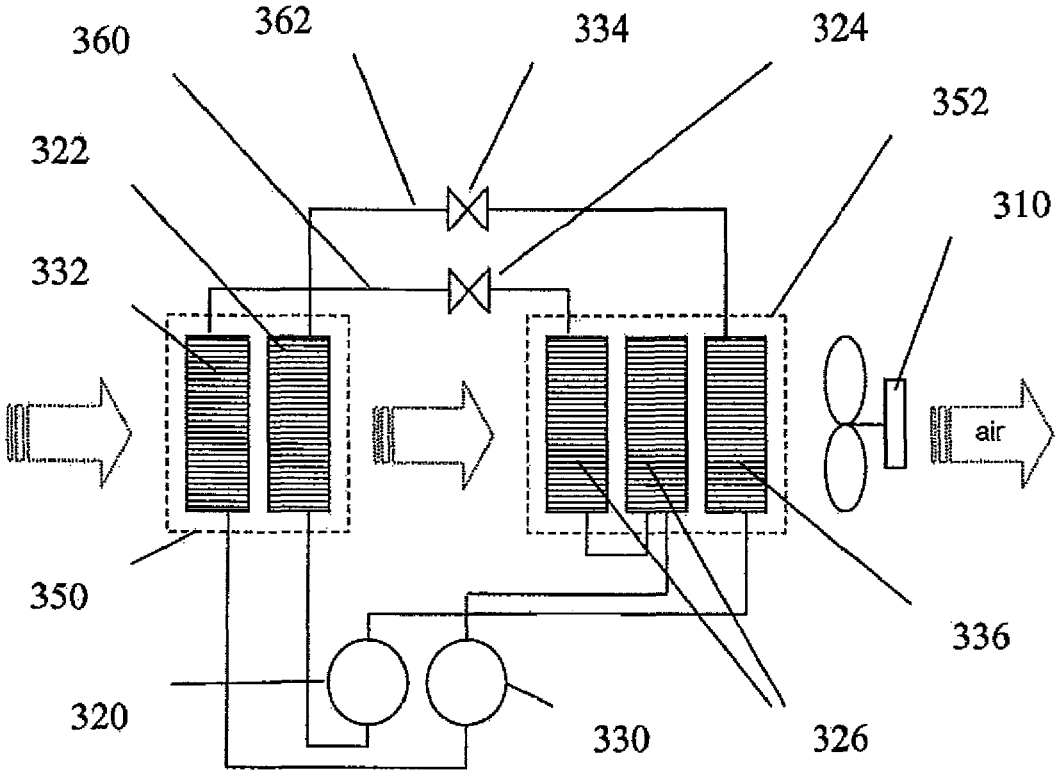
FIG. 4 is a schematic view of a second variant in the embodiment of the present invention.

FIG. 4 is a schematic view illustrating a second variant in the embodiment of the present invention, wherein—for reasons of greater illustrative simplicity—the multi-compressor heat-pump arrangement is shown again to be subdivided into two distinct circuits, i.e. a first closed-loop circuit and a second closed-loop circuit that comprise a first small-size fixed-speed compressor 320 and a second small-size fixed-speed compressor 330, a first expansion valve 324 and a second expansion valve 334, a first condenser 326 and a second condenser 336, and a first evaporator 322 and a second evaporator 332, respectively. Even in this case there may of course be used and provided any number of, i.e. n closed-loop circuits to form the heat-pump arrangement as desired.

With reference to a flow of drying air being circulated by the operation of a fan 310, the heat-pump arrangement comprises an evaporator 350, as formed by the evaporator 332 on the upstream side and the evaporator 322 on the downstream side, and a condenser 352, as formed by the condenser 326 on the upstream side and the condenser 336 on the downstream side.

The upstream evaporator 332, the downstream evaporator 322, the upstream condenser 326 and the downstream condenser 336 are aligned along a line of flow of the drying air. As a result, with reference to such arrangement, by connecting a first pair of such evaporator and condenser elements in a staggered sequence, i.e. the evaporator 332 with the condenser 326, to form the first closed-loop circuit, and a second pair of such evaporator and condenser elements in a staggered sequence, i.e. the evaporator 322 with the condenser 336, to form the second closed-loop circuit, a multi-compressor heat-pump arrangement is obtained, in which the first and the second closed-loop circuits cross each other, i.e. are in a cross-arrangement relative to each other, while anyway keeping separate from each other.

The remaining part of the structure of the clothes drying machine, as well as the operating mode and functions thereof, are unaltered with respect to the afore-described embodiments, so that any further description is intentionally omitted.

Fully apparent from the above description is therefore the ability of a heat-pump clothes drying machine according to present invention to effectively reach the aims and advantages cited afore by in fact providing a heat-pump clothes drying machine, in which no need arises for any particular electronic driving circuit to be used, actually, to implement complex compressor control schemes, thereby ensuring greater overall reliability and application simplicity.

It shall be appreciated that the inventive heat-pump clothes drying machine as described above is subject to a number of modifications and may be embodied in a number of different manners, or can be used in a number of different applications, without departing from the scope of the present invention as defined in the appended claims. It shall be further appreciated that all afore-described embodiments and related variants may be implemented either individually or in any possible combination thereof.

The invention claimed is:

1. Heat-pump clothes drying machine comprising a heat-pump arrangement for removing moisture from and heating up drying air, wherein said heat-pump arrangement comprises a plurality of separate closed-loop circuits, each one of said separate closed-loop circuits comprising at least one compressor, at least one evaporator, at least one expansion valve, and at least one condenser, wherein said at least one evaporator of each separate closed-loop circuit is disposed in series with respect to an evaporator of another of said closed-loop circuits to allow the drying air to cross said evaporators one after the other, and said at least one condenser of each separate closed-loop circuit is disposed in series with a condenser of another of said circuits to allow the drying air to cross said condensers one after the other, in order to increase or decrease thermic-exchange surface on demand.

2. Heat-pump clothes drying machine according to claim 1, wherein each compressor of said plurality of separate closed-loop circuits is of the fixed-speed type.

3. Heat-pump clothes drying machine according to claim 1, wherein the evaporator is formed internally of a plurality of distinct coils for the refrigerant medium to flow therethrough, a first end portion and a second end portion of each such coil being connected into a respective distinct closed-loop circuit of the heat-pump arrangement, said plurality of coils constituting a single heat-exchange surface.

4. Heat-pump clothes drying machine according to claim 1, wherein the condenser is formed internally of a plurality of distinct coils for the refrigerant medium to flow therethrough, a first end portion and a second end portion of each such coil being connected into a respective distinct closed-loop circuit of the heat-pump arrangement, said plurality of coils constituting a single heat-exchange surface.

5. Heat-pump clothes drying machine according to claim 1, wherein setting at least one compressor of said plurality of separate closed-loop circuits into operation is governed according to a binary logic.

6. Heat-pump clothes drying machine according to claim 5, wherein setting at least one compressor of said plurality of separate closed-loop circuits into operation occurs in at least one of a manual and automatic mode.

7. Heat-pump clothes drying machine according to claim 1, wherein said separate closed-loop circuits are in a cross-arrangement relative to each other.

8. Heat-pump clothes drying machine according to claim 2, wherein setting at least one compressor of said plurality of separate closed-loop circuits into operation is governed according to a binary logic.

9. Heat-pump clothes drying machine according to claim 8, wherein setting at least one compressor of said plurality of separate closed-loop circuits into operation occurs in at least one of a manual and automatic mode.

10. Heat-pump clothes drying machine according to claim 8, wherein said separate closed-loop circuits are in a cross-arrangement relative to each other.

11. Heat-pump clothes drying machine according to claim 3, wherein setting at least one compressor of said plurality of separate closed-loop circuits into operation is governed according to a binary logic.

12. Heat-pump clothes drying machine according to claim 11, wherein setting at least one compressor of said plurality of separate closed-loop circuits into operation occurs in at least one of a manual and automatic mode.

13. Heat-pump clothes drying machine according to claim 11, wherein said separate closed-loop circuits are in a cross-arrangement relative to each other.

14. Heat-pump clothes drying machine according to claim 4, wherein setting at least one compressor of said plurality of separate closed-loop circuits into operation is governed according to a binary logic.

15. Heat-pump clothes drying machine according to claim 14, wherein setting at least one compressor of said plurality of separate closed-loop circuits into operation occurs in at least one of a manual and automatic mode.

16. Heat-pump clothes drying machine according to claim 14, wherein said separate closed-loop circuits are in a cross-arrangement relative to each other.

* * * * *